US006986525B2

(12) United States Patent
Liard

(10) Patent No.: US 6,986,525 B2
(45) Date of Patent: Jan. 17, 2006

(54) BOARD FOR GLIDING OVER SNOW WITH IMPROVED SHOVEL AND TAIL TURN-UP

(75) Inventor: Jean Liard, Sallanches (FR)

(73) Assignee: Skis Rossignol S.A., Voiron (FR)

( * ) Notice: Subject to any disclaimer, the term of this patent is extended or adjusted under 35 U.S.C. 154(b) by 85 days.

(21) Appl. No.: 10/673,611

(22) Filed: Sep. 29, 2003

(65) Prior Publication Data

US 2004/0082395 A1 Apr. 29, 2004

(30) Foreign Application Priority Data

Oct. 15, 2002 (FR) ..... 02 12766

(51) Int. Cl.
*A63C 5/052* (2006.01)

(52) U.S. Cl. ..... 280/609; 280/602; 280/601

(58) Field of Classification Search ..... 280/609, 280/602, 610, 601, 608
See application file for complete search history.

(56) References Cited

U.S. PATENT DOCUMENTS

| | | | | |
|---|---|---|---|---|
| 2,369,004 | A * | 2/1945 | Andreef | 280/610 |
| 4,065,150 | A * | 12/1977 | Van Auken | 280/610 |
| 4,071,264 | A * | 1/1978 | Legrand et al. | 280/610 |
| 5,405,161 | A * | 4/1995 | Petkov | 280/609 |
| 5,603,522 | A * | 2/1997 | Nelson | 280/609 |
| 5,727,807 | A * | 3/1998 | Krafft et al. | 280/609 |
| 6,241,272 | B1 * | 6/2001 | Hammerle | 280/609 |
| 6,357,782 | B1 * | 3/2002 | Pieber et al. | 280/609 |
| 6,394,482 | B1 * | 5/2002 | Carlson | 280/601 |
| 6,481,741 | B1 | 11/2002 | Porte | |
| 6,499,759 | B2 * | 12/2002 | DeBorde et al. | 280/609 |
| 2001/0013694 | A1 * | 8/2001 | DeBorde et al. | 280/601 |
| 2002/0125661 | A1 | 9/2002 | Haakonsen et al. | |
| 2002/0158431 | A1 | 10/2002 | Porte | |
| 2003/0006584 | A1 * | 1/2003 | Carlson | 280/609 |
| 2003/0094787 | A1 * | 5/2003 | Riepler et al. | 280/609 |

FOREIGN PATENT DOCUMENTS

| | | | |
|---|---|---|---|
| EP | 1 221 334 A1 | | 7/2002 |
| FR | 2 659 023 A1 | | 9/1991 |
| FR | 2699827 | * | 7/1994 |
| FR | 2 804 335 A1 | | 8/2001 |
| SI | EP 0579865 A1 | * | 1/1994 |

* cited by examiner

*Primary Examiner*—Christopher P. Ellis
*Assistant Examiner*—J. Allen Shriver
(74) *Attorney, Agent, or Firm*—Burr & Brown

(57) ABSTRACT

A snow board, the camber of the side cut of which is accentuated, including a bottom surface (7) with a forward contact line ($L_{CAV}$), which is a forward limit of the contact zone of the bottom surface (7) on a horizontal planar surface ($P_H$), the board (1) being placed on the horizontal planar surface ($P_H$), and a shovel (2), which is a forward part of the board (1) that is curved upward in order to overcome obstacles, the shovel (2) having a width of the shoulder of the ski line ($L_{bV}$), defined as being a line on the bottom surface (7) in the shovel zone (2) at the location where its width ($b_V$) is at a maximum, wherein the height ($h_{AV}$) of the width of the shoulder of the ski line ($L_{bV}$), measured between said bottom surface (7) and said horizontal planar surface ($P_H$), is about 5 mm and to 15 mm.

24 Claims, 3 Drawing Sheets

BOARD FOR GLIDING OVER SNOW WITH IMPROVED SHOVEL AND TAIL TURN-UP

This application claims the benefit of French Application 02.12766, filed Oct. 15, 2002, the entirety of which is incorporated herein by reference.

The present invention relates to a board for gliding over snow, particularly an alpine ski having an improved shovel and/or tail turn-up.

As is known, the current trend is to improve the ease of use, i.e. the handleability and comfort of skis, particularly by means of an increase in weight. It has been possible to obtain this by reducing the length of the skis. Thus, over the last decade or so, the average length of a ski has shortened by about 30 to 40 cm—from an average length in the region of 1.90 m to 2 m to today's length that is close to 1.60 m. Therefore, the length of skis may be up to 10 cm shorter than the skier's height.

In a complementary manner, in order to retain a sufficiently large bearing surface, it will be observed that the width of skis, particularly at the shovel and/or at the tail turn-up, is constantly increasing. Thus, for example, the width of the shovel of a ski has increased by approximately 20%.

Moreover, there has been a further evolution in alpine skis, namely the tendency to adopt increasingly waisted side cuts. More precisely, the tendency to increase the side cut is a result of the increase in the width of the shovel and the tail relative to the width of the waist. Thus, this difference has practically doubled in the past ten years.

In point of fact, in skiing, skis are designed to increasingly facilitate "cut" turns, i.e. skidding of the afterbody of the ski when exiting a turn has progressively diminished, and is often non-existent. In such a case, turning is effected preferably "on the edge", which achieves a gain in precision and speed. The radii of curvature of "parabolic" skis are approximately 15 m, to allow the practice of "carving".

Thus, given the various evolutions in ski dimensions, it is apparent that the length of the edges is getting shorter and shorter, since the width of the shoulder of the ski line and the width of the heel of the ski line are located, respectively, at the forward contact line and the rear contact line. This generates edge grip at the start of the turn, when the skier turns his ski onto the edge, the usual position. Similarly, bearing forces on exiting a turn may also be too great. The result of this is that the trajectory of the ski, flat in a straight line or on the edge traversing a slope, is difficult to control.

SUMMARY OF THE INVENTION

A first problem that the invention proposes to solve is that of obtaining a short, waisted ski whose bearing surface area is increased relative to skis of the prior art. A second problem is the production of a ski whose shovel has dimension parameters such that it promotes more rapid and more progressive engagement of the ski at the start of a turn. A third problem is to design a ski with a tail turn-up having dimension parameters such that it promotes an increase in the progressive nature of the bearing forces on the ski when exiting a turn.

A board for gliding of "parabolic" type comprises a bottom surface with a forward contact line. This forward contact line is defined as being the forward limit of the contact zone of the bottom surface of the board on a horizontal planar surface, the board being placed on the horizontal planar surface. The board also comprises a shovel. This shovel is defined as being a forward part of the board that is curved upward in order to ride over obstacles. The shovel has a width of the shoulder of the ski line that is defined as being a line on the bottom surface of the board in the shovel zone at the location where its width is at a maximum.

According to a first aspect of the invention, the board is noteworthy in that the height of the width of the shoulder of the ski line, measured between said bottom surface and said horizontal planar surface, is substantially between 5 mm and 15 mm.

In other words, by virtue of the invention, during a turn, the length of contact of the edge of the board with the show is increased, despite a reduction in the total length of the board. Moreover, by moving the width of the shoulder of the ski line forward and upward relative to the forward contact line, the bearing forces applied by the skier are enhanced, though still progressive, when initiating a turn. When the board flexes during a turn, it is no longer the forward contact line that is the first thing in contact with the snow, but the width of the shoulder of the ski line. This gives rise to a situation in which the distance between the line of maximum width and the forward contact line at the edge becomes stressed during the turn, although it is a totally inactive zone, the board being flat.

Ski or board of "parabolic" type is understood to mean a board having side cuts waisted in order to obtain a radius of curvature during turning that is substantially in the region of 15 m, suited to the style of skiing that is commonly known as "carving".

Preferably, the height of the width of the shoulder of the ski line may be substantially between 8 mm and 12 mm, and may be preferably substantially equal to 10 mm.

The distance projected onto the horizontal planar surface, measured between the forward contact line and the width of the shoulder of the ski line, may be substantially between 40 mm and 90 mm. Preferably, the distance may be substantially between 50 mm and 80 mm, and may be preferably substantially equal to 65 mm.

The width of the shoulder of the ski may be substantially between 100 mm and 120 mm. Preferably, the width of the shoulder of the ski may be substantially between 105 mm and 115 mm, and may be preferably substantially equal to 109 mm.

The length of the shovel projected onto the horizontal planar surface, measured between the tip of the shovel and the forward contact line, may be substantially between 150 mm and 190 mm. Preferably, the length may be substantially between 155 mm and 185 mm, and may be preferably substantially equal to 160 mm.

The board also comprises a bottom surface with a rear contact line. This rear contact line is defined as being a rear limit of the contact zone of the bottom surface of the board on a horizontal planar surface, the board being placed on the horizontal planar surface. The board may also comprise a tail turn-up. This tail turn-up is defined as being a turned-up rear part of the board from the rear contact line. The tail turn-up has a width of the heel of the ski line, which is defined as being a line on the bottom surface in the zone of the tail turn-up at the location where its width is at a maximum.

The height of the width of the heel of the ski line, measured between said bottom surface and said horizontal planar surface, may be substantially between 1 mm and 50 mm. Preferably, the height may be substantially between 2 and 25 mm, and very preferably substantially equal to 4 mm.

In other words, during a turn, the board is on the edge and the total length of contact of the edge with the snow is increased from the width of the shoulder of the ski line as far as the width of the heel of the ski line, despite a reduction in the total length of the board. In other words, by pushing the width of the heel of the ski line rearward and upward relative to the forward contact line, the skier's bearing forces are enhanced when exiting a turn. When the board flexes during a turn, the entire edge, between the width of the shoulder of the ski line and the width of the heel of the ski line, becomes an effective distance stressed during turning, whereas only the width of the edge, located between the front and rear bearing points, is active, the board being flat. In other words, the ski or the board according to the invention makes it possible to increase the active edge width in a turn phase.

The distance projected onto the horizontal planar surface, measured between the rear contact line and the width of the heel of the ski line may be substantially between 2 mm and 100 mm. Preferably, the distance may be substantially between 10 mm and 70 mm, preferably substantially equal to 40 mm.

The width of the heel of the ski may be substantially between 85 mm and 120 mm. Preferably, the width may be substantially between 90 mm and 115 mm. In addition, this width may be very preferably substantially equal to 100 mm.

The length of the tail turn-up projected onto the horizontal planar surface, measured between the tail and the rear contact line, may be substantially between 2 mm and 100 mm. Preferably, the length may be substantially between 20 mm and 80 mm, and preferably substantially equal to 40 mm.

BRIEF DESCRIPTION OF THE FIGURES

The invention will be properly understood and its various advantages and different characteristics will become more apparent during the following description of the non-limiting illustrative embodiment, with reference to the appended diagrammatic drawings, in which.

DETAILED DESCRIPTION OF THE INVENTION

Figure 1:
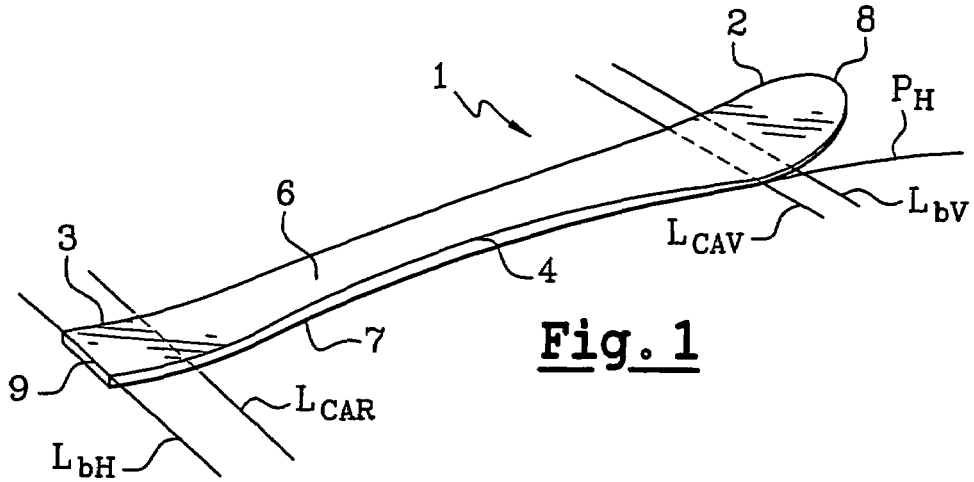
FIG. 1 shows a perspective view of an alpine ski.

As illustrated in FIGS. 1 to 8, a board for gliding over snow, such as an alpine ski (1), comprises a shovel (2), a tail turn-up (3), a waist zone (4), two side edges (5), a top surface (6) formed by a protective, decorative upper layer, and a bottom surface (7) delimited on either side by the two side edges (5).

According to paragraph 3.1.8 of ISO Standard 6289, the shovel (2) is defined as being the forward section of the ski (1), which is turned up in order to ride easily over obstacles. According to paragraph 3.1.12 of the same standard, the tail turn-up (3) is defined as being the portion of the ski (1) rearward of the rear contact line. According to paragraph 3.1.1. of the same standard, the bottom surface (7) is defined as being the side of the ski (1) which interfaces the snow when skiing. The bottom surface (7) corresponds essentially to the gliding base bordered by side edges (5).

The shovel (2) comprises the tip (8) of the ski (1). According to paragraph 3.1.6 of the same standard, the tip (8) is defined as being the extreme forward point of the ski (1).

The ski (1) with the shovel (2) has a forward contact line ($L_{CAV}$). According to paragraph 3.1.9 of the same standard, the forward contact line ($L_{CAV}$) is defined as being the forwardmost contact line between the bottom surface (7) of the ski (1) and a flat surface ($P_H$) against which the ski (1) is pressed. The width of the ski (1) at the forward contact line ($L_{CAV}$) is substantially between 85 and 115 mm. Preferably, the width of the ski (1) is substantially between 90 and 110 mm. Solely by way of example, this width is substantially equal to 103 mm.

The ski (1) with the shovel (2) has a width of the shoulder of the ski line ($L_{bV}$) that is distinct and located forward of the forward contact line ($L_{CAV}$) toward the tip (8) of the ski (1). According to paragraph 4.7.2.1 of the same standard, the width of the shoulder of the ski ($b_V$) is defined as being the maximum width of the shovel section of the ski (1).

Figure 2:
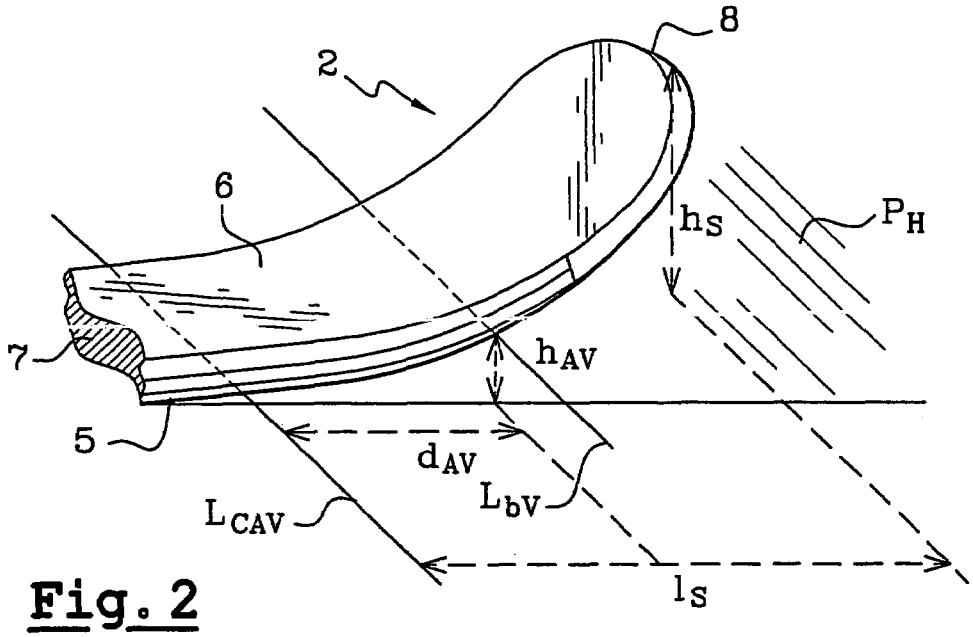
FIG. 2 shows a perspective view of the shovel of the ski according to the invention.
Figure 3:
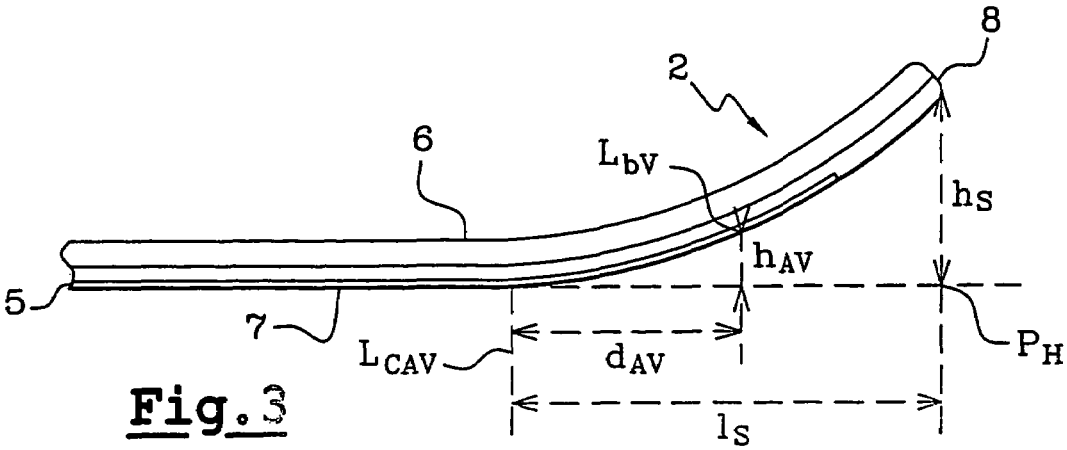
FIG. 3 shows a side view of the shovel of FIG. 2.

A height ($h_{AV}$) of the width of the shoulder of the ski line ($L_{bV}$) is measured between the bottom surface (7) and the horizontal planar surface ($P_H$) (see FIGS. 2 and 3). According to the invention, a value for the height ($h_{AV}$) that has given a particularly high-performance ski is substantially 10 mm.

When the ski (1) is on the edge (5), the width of the shoulder of the ski line ($L_{bV}$) becomes the temporarily effective forward contact line. At the start of the turn, the width of the shoulder of the ski line ($L_{bV}$) is stressed first of all, which makes the ski (1) engage more quickly and more progressively when initiating the turn.

Figure 4:
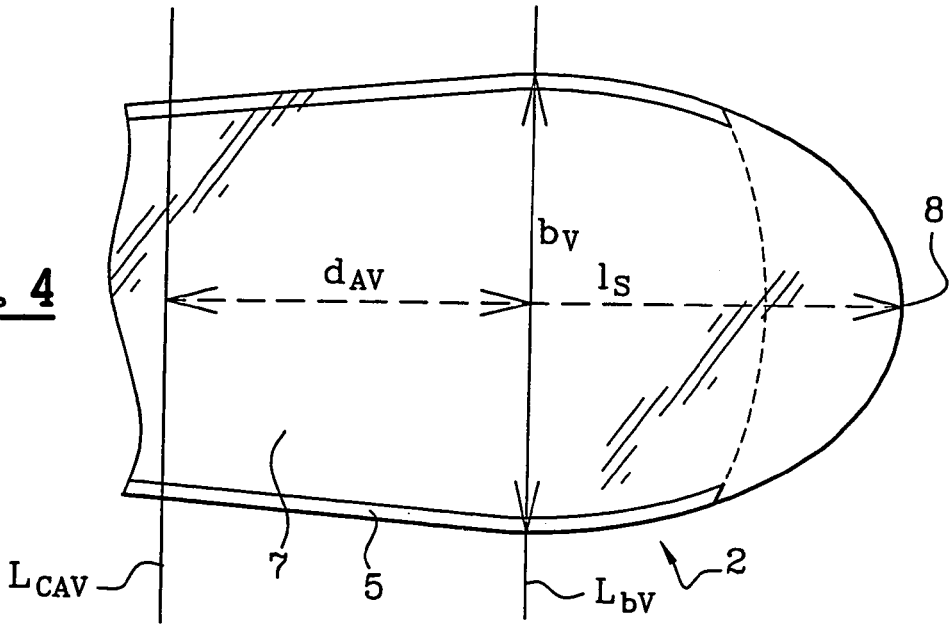
FIG. 4 shows a bottom view of the shovel of FIG. 2.

A distance ($d_{AV}$) is measured between the forward contact line ($L_{CAV}$) and the width of the shoulder of the ski line ($L_{bV}$) (see FIGS. 2, 3, and 4). This is the distance ($d_{AV}$) projected onto the horizontal planar surface ($P_H$). According to the invention, a value for the distance ($d_{AV}$) that has given a particularly high-performance ski is substantially 65 mm.

The width of the shoulder of the ski ($b_V$) is measured from edge to edge at the width of the shoulder of the ski line ($L_{bV}$) (see FIGS. 2, 3, and 4). According to the invention, a value for the width of the shoulder of the ski ($b_V$) that has given a particularly high-performance ski is substantially 109 mm.

The length of the shovel ($l_S$) is measured between the tip (8) and the forward contact line ($L_{CAV}$) (see FIGS. 2, 3, and 4). This is the length ($l_S$) projected onto the horizontal planar surface ($P_H$). According to the invention, a value for the length of the shovel ($l_S$) that has given a particularly high-performance ski is substantially 160 mm, which corresponds to approximately 175 mm for a "developed" shovel length.

According to paragraph 4.10 of the same standard, the tip height ($h_S$) is defined as being the height of the underside of the tip (8) measured from a planar surface ($P_H$) with the ski body pressed against the surface. This height ($h_S$) of the shovel (2) is substantially between 25 and 60 mm. Preferably, the tip height ($h_S$) may be substantially between 35 mm and 55 mm. In addition, for a particularly high-performance ski (1), this height ($h_S$) may be very preferably substantially equal to 45 mm.

The tail turn-up (3) comprises the rear tail (9) of the ski (1). According to paragraph 3.1.7 of the same standard, the tail (9) is defined as being the extreme rear-edge point of the ski (1).

The ski (1) with the tail turn-up (3) has a rear contact line ($L_{CAR}$). According to paragraph 3.1.10 of the same standard, the rear contact line ($L_{CAR}$) is defined as being the rearmost contact line between the bottom surface (7) of the ski (1) and a flat surface ($P_H$) against which the ski body is pressed. The width of the ski (1) at the rear contact line ($L_{CAR}$) is substantially between 80 and 120 mm. Preferably, the width of the ski (1) is substantially between 90 and 110 mm. Solely by way of example, this width is substantially equal to 92 mm.

The ski (1) with the tail turn-up (3) has a width of the heel of the ski line ($L_{bH}$) that is distinct and located rearward of the rear contact line ($L_{CAR}$) toward the tail (9) of the ski (1). According to paragraph 4.7.2.3 of the same standard, the width of the heel of the ski ($b_H$) is defined as being the maximum width of the running surface in the rear section of the ski (1).

Figure 5:
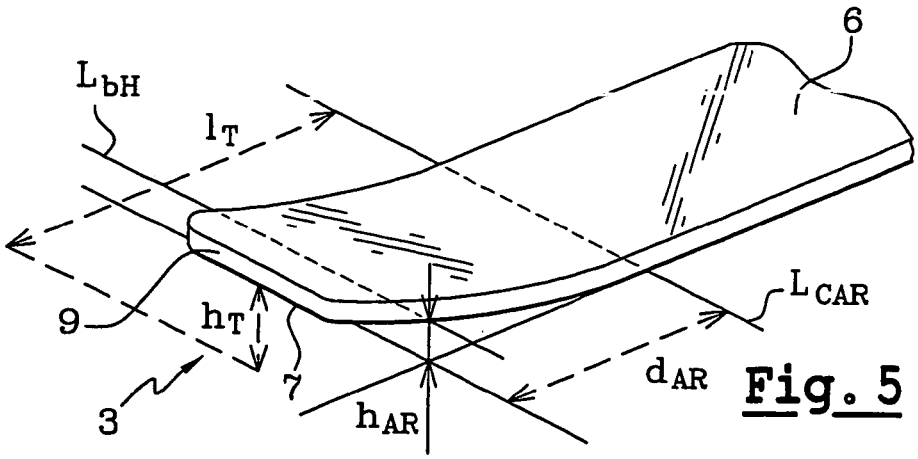
FIG. 5 shows a perspective view of the tail turn-up according to the invention.
Figure 6:
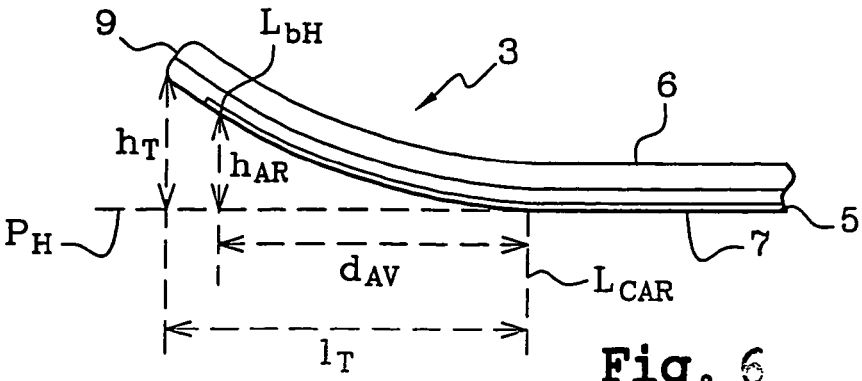
FIG. 6 shows a side view of the tail turn-up of FIG. 5.

A height ($h_{AR}$) of the width of the heel of the ski line ($L_{bH}$) is measured between the bottom surface (7) and the horizontal planar surface ($P_H$) (see FIGS. 5 and 6). According to a second aspect of the invention, a value for the height ($h_{AR}$) that has given a particularly high-performance ski is substantially 4 mm.

When the ski (1) is on the edge (5), the width of the heel of the ski line ($L_{bH}$) becomes the temporarily effective rear contact line. Upon exiting a curve, the width of the heel of the ski line ($L_{bH}$) is stressed last, which makes the ski (1) grip better at the end of the turn.

Figure 7:
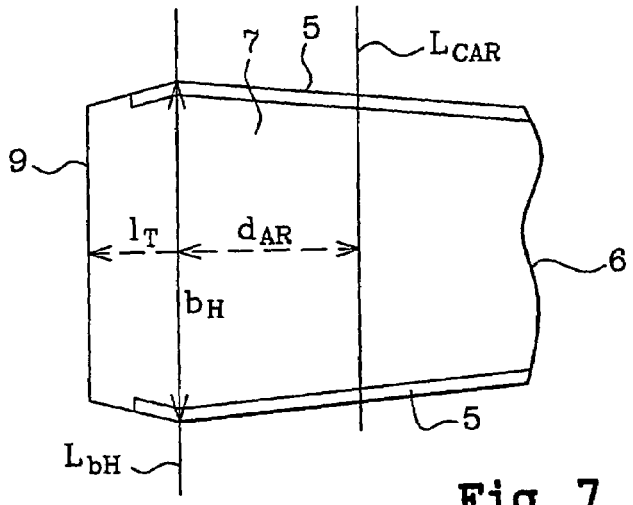
FIG. 7 shows a bottom view of the tail turn-up of FIG. 5.
Figure 8:
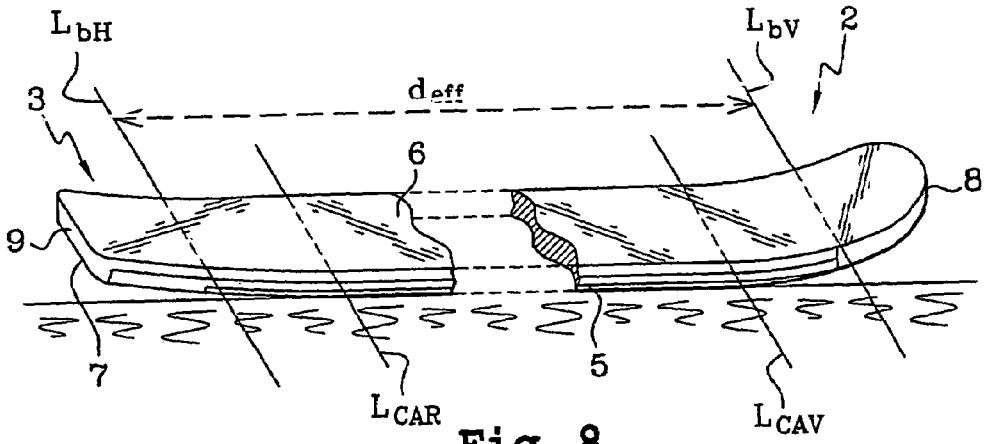
FIG. 8 shows a partial perspective view of the alpine ski of FIG. 1, turning on the edge.

A distance ($d_{AR}$) is measured between the rear contact line ($L_{CAR}$) and the width of the heel of the ski line ($L_{bH}$) (see FIGS. 5, 6, and 7). This is the distance ($d_{AR}$) projected onto the horizontal planar surface ($P_H$). According to the invention, a value for the distance ($d_{AR}$) that has given a particularly high-performance ski is substantially 40 mm.

The width of the heel of the ski ($b_H$) is measured from edge to edge at the width of the heel of the ski line ($L_{bH}$) (see FIGS. 5, 6, and 7). According to the invention, a value for the width of the heel of the ski ($b_H$) that has given a particularly high-performance ski is substantially 100 mm.

The length of the tail turn-up ($l_T$) is measured between the tail (9) and the rear contact line ($L_{CAR}$) (see FIGS. 5, 6, and 7). This is the length ($l_T$) projected onto the horizontal planar surface ($P_H$). According to the invention, a value for the tail-turn-up length ($l_T$) that has given a particularly high-performance ski is substantially 40 mm.

In another, particularly advantageous embodiment, the width of the heel of the ski line ($L_{bH}$) is moved back as far as the tail (9). In this case, the width of the heel of the ski ($b_H$) is equal to the width of the tail (9). In addition, the distance ($d_{AR}$) between the rear contact line ($L_{CAR}$) and the width of the heel of the ski line ($L_{bH}$) is equal to the tail-turn-up length ($l_T$).

According to paragraph 4.11 of the same standard, the tail height ($h_T$) is the height of the underside of the tail (9) measured from a planar surface ($P_H$) with the ski body pressed against the surface. This height ($h_T$) of the tail (9) is substantially between 1 mm and 50 mm. Preferably, the tail height ($h_T$) may be substantially between 2 mm and 25 mm. In addition, this height ($h_T$) may be very preferably substantially equal to 4 mm.

The width at the waist (4) is substantially between 60 mm and 90 mm. Preferably, the width at the waist (4) may be substantially between 65 mm and 85 mm, and preferably substantially equal to 68 mm.

Figure 9:
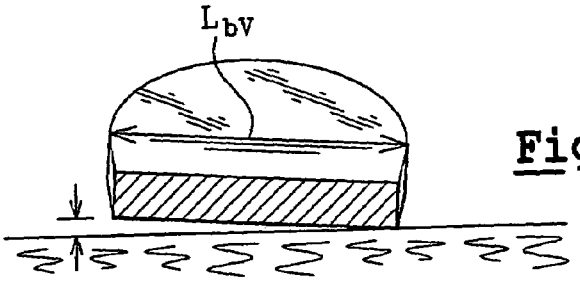
FIG. 9 is a sectional view of FIG. 8, at the forward contact line.

When the skier takes a turn, he angles his ski (1) relative to the slope. Thus, when the ski (1) is positioned on one of the two edges (5) during a turn (see FIGS. 8 and 9), it flexes under the bearing forces generated by the skier while edge-gripping. The edge at the waist zone (4) is pressed against the snow. The distance ($d_{AV}$) between the forward contact line ($L_{CAV}$) and the width of the shoulder of the ski line ($L_{bV}$), and the distance ($d_{AR}$) between the rear contact line ($L_{CAR}$) and the width of the heel of the ski line ($L_{bH}$), which are inactive and raised when the ski (1) is flat, become stressed lengths while edge-gripping. The distance ($d_{eff}$) between the width of the shoulder of the ski line ($L_{bV}$) and the width of the heel of the ski line ($L_{bH}$) becomes the stressed edge length.

The present invention is not limited to the embodiments described and illustrated. Numerous modifications may be made without thereby departing from the context defined by the scope of the set of claims. In particular, the principle of the invention may be applied to a snowboard in which the wider shovel and tail zones are raised relative to a horizontal plane by a height in excess of 5 mm so as to make grip when initiating and exiting a turn more progressive, whether backside or frontside.

What is claimed is:

1. A board for gliding over snow, having a side cut with an accentuated camber, comprising a bottom surface with a forward contact line, defined as being a forward limit of a contact zone of the bottom surface of the board on a horizontal planar surface, the board being placed on the horizontal planar surface, and a shovel, defined as being a forward part of the board that is curved upward in order to overcome obstacles, the shovel having a width of the shoulder of the ski line, defined as being a line on the bottom surface of the shovel at the location where a width of the shoulder of the ski is at a maximum, wherein the width of the shoulder of the ski line is distinct from and located forward of the forward contact line toward the shovel and wherein a height ($h_{AV}$) of the width of the shoulder of the ski line, measured between the bottom surface and the horizontal planar surface, is substantially between 5 mm and 15 mm.

2. The board for gliding as claimed in claim 1, wherein the height ($h_{AV}$) is substantially between 8 mm and 12 mm.

3. The board for gliding as claimed in claim 1, wherein a distance ($d_{AV}$) projected onto the horizontal planar surface, measured between the forward contact line and the width of the shoulder of the ski line, is substantially between 40 mm and 90 mm.

4. The board for gliding as claimed in claim 3, wherein the distance ($d_{AV}$) is substantially between 50 mm and 80 mm.

5. The board for gliding as claimed in claim 3, wherein the distance ($d_{AV}$) is substantially equal to 65 mm.

6. The board for gliding as claimed claim 1, wherein the width of the shoulder of the ski is substantially between 100 mm and 120 mm.

7. The board for gliding as claimed in claim 6, wherein the width of the shoulder of the ski is substantially between 105 mm and 115 mm.

8. The board for gliding as claimed in claim 6, wherein the width of the shoulder of the ski is substantially equal to 109 mm.

9. The board for gliding as claimed in claim 1, wherein a length ($l_S$) of the shovel projected onto the horizontal planar surface, measured between a tip of the board and the forward contact line, is substantially, between 150 mm and 190 mm.

10. The board for gliding as claimed in claim 9, wherein the length ($l_S$) is substantially between 155 mm and 180 mm.

11. The board for gliding as claimed in claim 9, wherein the length of the shovel projected onto the horizontal planar surface measure between the tip and the forward contact line is substantially equal to 160 mm.

12. The board for gliding as claimed in claim 1, further comprising a rear contact line, defined as being a rear limit of the contact zone of the bottom surface of the board on the horizontal planar surface, the board being placed on the horizontal planar surface, and a tail turn-up, defined as being a turned-up rear part of the board from the rear contact line, the tail turn-up having a width of the heel of the ski line, defined as being a line on the bottom surface in a zone of the tail turn-up at a location where a width of the heel of the ski is at a maximum, and a height of the width of the heel of the ski line, measured between the bottom surface and the horizontal planar surface, is substantially between 1 mm and 50 mm.

13. The board for gliding as claimed in claim 12, wherein a distance projected onto the horizontal planar surface, measured between the rear contact line and the width of the heel of the ski line, is substantially between 2 mm and 100 mm.

14. The board for gliding as claimed in claim 12, wherein the width of the heel of the ski is substantially between 85 mm and 120 mm.

15. The board for gliding as claimed in claim 12, wherein a length of the tail turn-up projected onto the horizontal planar surface, measured between the tail and the rear contact line, is substantially between 2 mm and 100 mm.

16. The board for gliding as claimed in claim 12, wherein a distance projected onto the horizontal surface planar, measure between the rear contact line and the width of the heel of the ski line, is substantially between 10 and 70 mm.

17. The board for gliding as claimed in claim 12, wherein a distance projected onto the horizontal surface planar, measure between the rear contact line and the width of the heel of the ski line, is substantially equal to 40 mm.

18. The board for gliding as claimed in claim 12, wherein the width of the heel of the ski is substantially between 90 and 115 mm.

19. The board for gliding as claimed in claim 12, wherein the width of the heel of the ski is substantially equal to 100 mm.

20. The board for gliding as claimed in claim 12, wherein the length of the tail turn-up project onto the horizontal surface, measure between the tail and the rear contact line, is substantially between 20 and 80 mm.

21. The board for gliding as claimed in claim 12, wherein the length of the tail turn-up project onto the horizontal surface, measure between the tail and the rear contact line, is substantially equal to 40 mm.

22. The board for gliding as claimed in claim 1, wherein the height ($h_{AV}$) is substantially equal to 10 mm.

23. The board for gliding as claimed in claim 1, further comprising a rear contact line, defined as being a rear limit of the contact zone of the bottom surface of the board on the horizontal planar surface, the board being placed on the horizontal planar surface, and a tail turn-up, defined as being a turned-up rear part on the board from the rear contact line, the tail turn-up having a width of the heel of the ski line, defined as being a line on the bottom surface in a zone of the tail turn-up at a location where a width of the heel of the ski is at a maximum, and a height of the width of the heel of the ski line, measure between the bottom surface and the horizontal planar surface, is substantially between 2 and 25 mm.

24. The board for gliding as claimed in claim 1, further comprising a rear contact line, defined as being a rear limit of the contact zone of the bottom surface of the board on the horizontal planar surface, the board being placed on the horizontal planar surface, and a tail turn-up, defined as being a turned-up rear part on the board from the rear contact line, the tail turn-up having a width of the heel of the ski line, defined as being a line on the bottom surface in a zone of the tail turn-up at a location where a width of the heel of the ski is at a maximum, and a height of the width of the heel of the ski line, measure between the bottom surface and the horizontal planar surface, is substantially equal to 4 mm.

* * * * *